US009410516B2

(12) United States Patent
Maess et al.

(10) Patent No.: US 9,410,516 B2
(45) Date of Patent: Aug. 9, 2016

(54) METHOD FOR OPERATING A FUEL SYSTEM FOR AN INTERNAL COMBUSTION ENGINE

(71) Applicant: Robert Bosch GmbH, Stuttgart (DE)

(72) Inventors: Matthias Maess, Boeblingen (DE); Joerg Kuempel, Ludwigsburg (DE); Rainer Wilms, Markgroeningen (DE); Uwe Richter, Markgroeningen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 91 days.

(21) Appl. No.: 14/402,629

(22) PCT Filed: Apr. 24, 2013

(86) PCT No.: PCT/EP2013/058506
§ 371 (c)(1),
(2) Date: Nov. 20, 2014

(87) PCT Pub. No.: WO2013/174604
PCT Pub. Date: Nov. 28, 2013

(65) Prior Publication Data

US 2015/0136090 A1 May 21, 2015

(30) Foreign Application Priority Data

May 23, 2012 (DE) ..... 10 2012 208 614

(51) Int. Cl.

| | |
|---|---|
| ***F02M 59/36*** | (2006.01) |
| ***F02M 51/06*** | (2006.01) |
| ***F02D 41/20*** | (2006.01) |
| ***F02D 1/02*** | (2006.01) |
| ***F02D 41/38*** | (2006.01) |
| *F02D 41/24* | (2006.01) |

(52) U.S. Cl.
CPC ..... *F02M 51/061* (2013.01); *F02D 1/02* (2013.01); *F02D 41/20* (2013.01); *F02D 41/247* (2013.01); *F02D 41/3845* (2013.01); *F02D 41/2438* (2013.01); *F02D 2041/2055* (2013.01)

(58) Field of Classification Search
CPC . F02M 51/061; F02M 59/365; F02M 59/366; F02D 1/02; F02D 41/3854; F02D 41/20; F02D 41/247; F02D 41/2438; F02D 2041/2055
USPC ..... 123/457, 458, 510, 511
See application file for complete search history.

(56) References Cited

U.S. PATENT DOCUMENTS 5,230,613 A * 7/1993 Hilsbos ..... F02M 47/027 123/456
7,178,506 B2 * 2/2007 Kojima ..... F02B 23/104 123/431

FOREIGN PATENT DOCUMENTS

DE 199 45 618 3/2001
DE 103 05 523 8/2004

(Continued)

OTHER PUBLICATIONS

International Search Report for PCT/EP2013/058506, dated Sep. 11, 2013.

*Primary Examiner* — Hai Huynh
(74) *Attorney, Agent, or Firm* — Norton Rose Fulbright US LLP

(57) ABSTRACT

A method for operating a fuel system for an internal combustion engine having a metering device, an electrical actuating device, and a valve element includes: activating the electrical actuating device in at least one first cycle in such a way that the valve element switches into a second position corresponding to an open metering device; activating the electrical actuating device in at least one second cycle in such a way that the electrical actuating device is activated from activation to activation, with activation energy which decreases gradually, until a limiting case is reached in which the valve element only just or just no longer switches into the second position; ascertaining a first activation energy, which corresponds to the limiting case; and subsequently activating the actuating device, taking the first activation energy into account.

13 Claims, 6 Drawing Sheets

(56) References Cited

FOREIGN PATENT DOCUMENTS

| | | |
|---|---|---|
| DE | 10 2006 027823 | 12/2007 |
| DE | 10 2007 035 316 | 1/2009 |
| DE | 10 2010 021168 | 11/2011 |
| DE | 10 2010 0439 | 5/2012 |
| DE | 10 2011 085 277 | 5/2013 |
| WO | WO 2006/029931 | 3/2006 |

* cited by examiner

METHOD FOR OPERATING A FUEL SYSTEM FOR AN INTERNAL COMBUSTION ENGINE

BACKGROUND OF THE INVENTION

1. Field of the Invention

The present invention relates to a method, a control device, and a computer program for operating a fuel system for an internal combustion engine.

2. Description of the Related Art

Fuel supply control valves, for example in a fuel system of an internal combustion engine, are known from the market. Fuel supply control valves are generally operated electromagnetically as switching valves having two switching positions, and frequently are an integral part of a high-pressure pump of the fuel system. The fuel supply control valve controls the fuel quantity pumped to a high-pressure accumulator ("rail"), from which fuel is led to the injectors of the internal combustion engine. An armature which is coupled to a valve element of the fuel supply control valve may be moved by magnetic force. The valve element, usually an inlet valve of the high-pressure pump, may strike against a valve seat or may be lifted from the valve seat. A supplied fuel quantity for the internal combustion engine, and thus, ultimately, the pressure in the rail, may be regulated in this way. A published German patent application document in this field is DE 10 2007 035 316 A1, for example.

BRIEF SUMMARY OF THE INVENTION

The present invention has the advantage that an energization of an electrical actuating device for a metering device of a fuel system for an internal combustion engine may be reduced (so-called "reduced current control"). A speed of moving elements of the metering device as well as operating noise of the metering device, in particular in a low-speed range of the internal combustion engine, may be reduced in this way. The method according to the present invention allows the energization to be reduced as a function of a particular specimen of the metering device. Reliable switching of the metering device may still be achieved, essentially independently of specimen variations, temperatures, or an ohmic resistance of supply lines of the electrical actuating device.

The present invention relates to a method for operating a fuel system for an internal combustion engine, the metering device for measuring a delivery quantity of the fuel being openable and/or closable with the aid of the electrical actuating device, and a valve element of the metering device may switch into a first position when the actuating device is not activated, and into a second position when the actuating device is activated. The first position corresponds to a closed metering device, and the second position corresponds to an open metering device. In a first alternative, the method is characterized by the following steps:

(a) activating the electrical actuating device in at least one first cycle in such a way that the valve element reliably switches into the second position;

(b) activating the electrical actuating device in at least one second cycle in such a way that the electrical actuating device is activated from activation to activation, with activation energy which decreases gradually, until a limiting case is reached in which the valve element only just or just no longer switches into the second position;

(c) ascertaining a first activation energy, which corresponds to the limiting case;

(d) subsequently activating the actuating device, taking the first activation energy into account.

Thus, starting from an activation of the electrical actuating device that is sufficient for reliably switching into the second position, the activation energy is reduced gradually, and the limiting case is "felt out," so to speak, "from above." At the same time, the first activation energy which is part of the limiting case is ascertained and subsequently used as a reference value for activating the electrical actuating device. The first activation energy is thus at least necessary as a limiting case in order to reliably switch the electrical actuating device. The electrical actuating device is preferably designed as an electromagnetic actuating device, and includes a coil and an armature which is movable by magnetic force. Alternatively, it is also conceivable to carry out the method according to the present invention with an electrical actuating device which includes a piezoactuator. The metering device corresponds to a so-called fuel supply control valve which includes, for example, an inlet valve situated upstream from a fuel pump of the fuel system.

A second alternative for ascertaining the limiting case is characterized by the following steps:

(a) activating the electrical actuating device in at least one first cycle in such a way that the valve element does not reliably switch into the second position;

(b) activating the electrical actuating device in at least one second cycle in such a way that the electrical actuating device is activated from activation to activation, with activation energy which increases gradually, until a limiting case is reached in which the valve element only just or just no longer switches into the second position;

(c) ascertaining the first activation energy, which corresponds to the limiting case;

(d) subsequently activating the actuating device, taking the first activation energy into account.

The second alternative of the method is thus analogously carried out in reverse order with respect to the first alternative. The activation energy is increased gradually, and the limiting case is "felt out," so to speak, "from below." Both described alternatives result in the same limiting case and the same first activation energy. It is understood that in both alternatives, the activation energy may also be gradually increased and decreased in alternation in a range around the presumed limiting case in order to accurately "sound out" the limiting case. Likewise, it is understood that in steps (b) the activation energy does not necessarily have to be changed in a strictly monotonic manner with each subsequent activation. Thus, it is certainly possible for multiple successive activations to use the same activation energy.

In the present case, "activation energy" is generally understood to mean a variation in time of a current flowing through the electrical actuating device. A switching characteristic of the electrical actuating device is thus a function of the time curve of the current ("current profile") corresponding to an associated time integral. The time integral of the current multiplied by a voltage has the dimension of energy.

In one embodiment of the method, after step (c) the first activation energy is increased by an offset value, resulting in a second activation energy, the offset value being dimensioned in such a way that the valve element may robustly switch into the second position. The subsequent activation in step (d) with the second activation energy takes place in a similar way. The reliability of the switching corresponding to the offset value may thus be optionally improved, in that it becomes more robust with regard to disturbances such as changes in temperature and/or changes in voltage.

In one preferred embodiment of the method, the first position corresponds to a closed metering device, and the second position corresponds to an open metering device. As a result, it is possible for the metering device in the de-energized state to be closed by devices which control the fuel system, and for the fuel to not be able to flow uncontrolled. The fuel system may thus be kept in a defined state.

In a first option according to the present invention for ascertaining the limiting case, a pressure and/or a pressure change and/or a rate of pressure change in a pressure accumulator, in particular in a high-pressure accumulator ("rail"), of the fuel system is/are ascertained and compared to a threshold value. The limiting case may be recognized, for example, by a rise in the rail pressure over time. Appropriate threshold values may be predefined for this purpose. It may thus be ascertained, for example, whether a certain fuel pressure is exceeded, and/or whether, starting from an initial value of the fuel pressure, a pressure change has exceeded a predefined threshold value, and/or whether the rate of pressure change has exceeded a predefined threshold value. The limiting case may thus be ascertained in a particularly precise way.

In a second option according to the present invention for ascertaining the limiting case, a voltage and/or a current of the electrical actuating device is/are ascertained and evaluated. Comparatively rapid changes in the movement of the valve element result in a corresponding change in the movement of the armature, and thus, a corresponding change in a magnetic field surrounding the armature. According to Faraday's law of induction, a voltage is thus generated in a coil of the electromagnetic actuating device which is ascertainable at terminals of the electromagnetic actuating device.

In addition, it may be provided that the second activation energy and/or a time curve of the activation corresponding to the second activation energy or a time curve of the current is/are stored in a data store, using a characteristic map, for example. Thus, for the subsequent activation of the electromagnetic actuating device, the stored value may be read out from the data store, and therefore needs to be ascertained only occasionally or periodically during operation of the metering device. The availability of the stored final state may thus be increased by dispensing with the adaptation operations. In addition, it may be provided to store further variables or parameters, for example a speed of the internal combustion engine together with the activation energy or the time curve of the current.

A first alternative of the activation of the electromagnetic actuating device provides that a time curve of the activation includes a first phase having a monotonically increasing current curve, and that the time curve includes a subsequent second phase in which the electrical actuating device is activated with the aid of a pulse width modulation, and that a duration of the first phase and/or a pulse duty factor of the pulse width modulation within the second phase is/are changed in order to ascertain the limiting case. A first temporal "current profile" is thus described which is particularly suitable for carrying out the method.

A second alternative of the activation of the electromagnetic actuating device provides that the time curve of the activation includes a first phase having a monotonically increasing current curve, and that the time curve includes a subsequent second phase in which the electrical actuating device is energized with the aid of a regulatable current, and that a duration of the first phase and/or an intensity of the regulatable current within the second phase is/are changed in order to ascertain the limiting case. A second temporal "current profile" is thus described which is particularly suitable for carrying out the method.

A third alternative of the activation of the electromagnetic actuating device provides that the time curve of the activation includes a first phase in which the electrical actuating device is energized with the aid of a first regulatable current, and that the time curve includes a subsequent second phase in which the electrical actuating device is energized with the aid of a second regulatable current, the second current being lower than the first current, and that a duration of the first phase and/or an intensity of the second regulatable current is/are changed in order to ascertain the limiting case. A third temporal "current profile" is thus described which is particularly suitable for carrying out the method.

In addition, in the above-described three alternatives, the time curve of the activation may include a third phase, following the second phase, in which the electrical actuating is activated or energized with the aid of a pulse width modulation or a third regulatable current. Any premature drop of the valve element from the second position back into the first position due to currents which are possibly too low may thus be avoided. The effective current is generally higher in the third phase than in the second phase.

According to another embodiment of the method, the above-described offset value may be predefined as a function of the fuel pressure in the pressure accumulator and/or a fuel temperature and/or an electrical resistance of electrical lines attached to the electrical actuating device. The offset value may thus be dimensioned to be compatible with the existing operating parameters, so that the offset value may be selected to be comparatively small. The second activation energy is thus appropriately low without reducing the reliability of the switching of the valve element. Multiple offset values may preferably be stored as a function of multiple operating parameters in a characteristic map of the control and/or regulation device for the internal combustion engine.

The mentioned control and/or regulation device for the internal combustion engine is particularly useful for the method according to the present invention, since it already centrally contains a number of operating variables of the fuel system and the internal combustion engine for carrying out the method. The method is preferably carried out with the aid of a computer program.

DETAILED DESCRIPTION OF THE INVENTION

Figure 1:
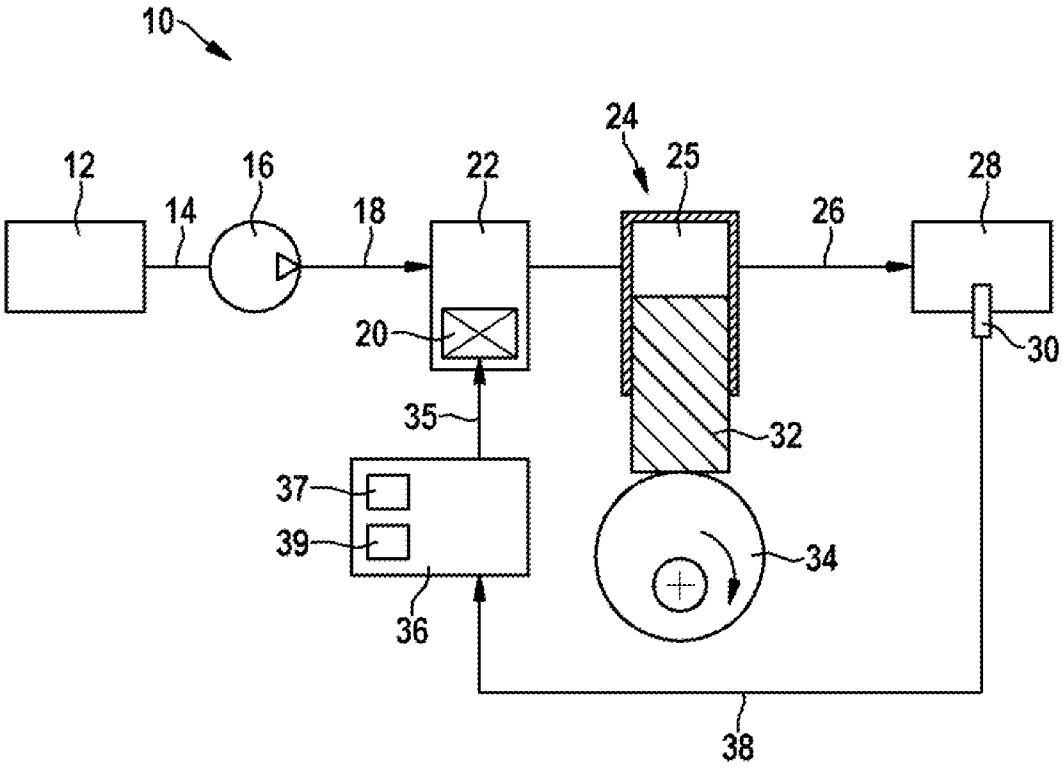
FIG. 1 shows a fuel system for an internal combustion engine.

The same reference numerals are used for functionally equivalent elements and variables in all the figures, even for different specific embodiments.

FIG. 1 shows a fuel system 10 for an internal combustion engine (not illustrated) in a greatly simplified illustration. Fuel is supplied from a fuel tank 12, via an intake line 14 with the aid of a pre-feed pump 16, via a low-pressure line 18, and via a fuel supply control valve 22, which is activatable by an electrical actuating device 20 (designed as an electromagnetic actuating device in the present case), to a piston pump 24 (high-pressure pump) which is mechanically driven by the internal combustion engine. Fuel supply control valve 22 forms a metering device for measuring a supplied quantity of the fuel.

Downstream, piston pump 24 is connected to a pressure accumulator 28 (high-pressure accumulator, "common rail") via a high-pressure line 26. A pressure sensor 30 is situated at pressure accumulator 28. Piston pump 24 includes a piston 32, which in the drawing is vertically movable, and in the present case drivable with the aid of an eccentric disk 34. Electrical actuating device 20 is activated by a control and/or regulation device 36 via electrical lines 35. Control and/or regulation device 36 includes a data store 37 and a computer program 39. In addition, control and/or regulation device 36 is connected to pressure sensor 30 via an electrical line 38.

Figure 2:
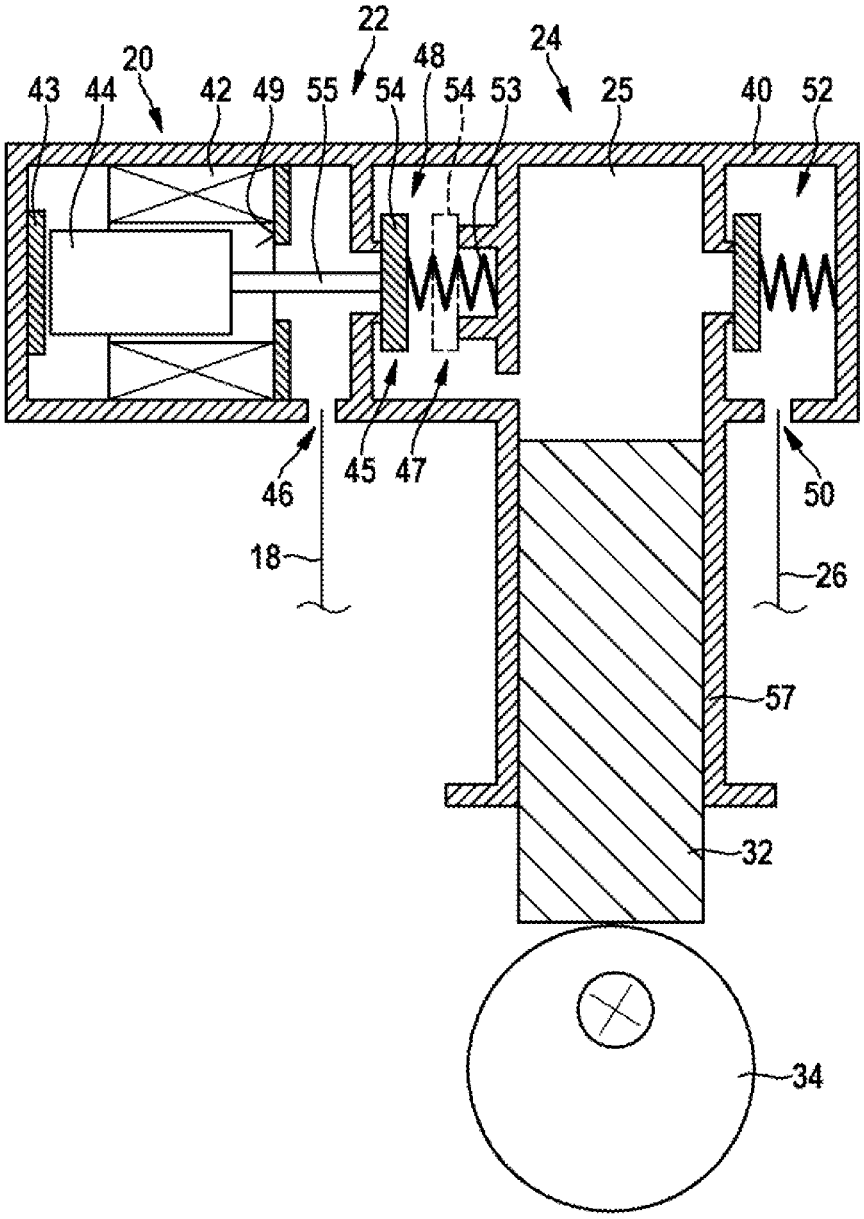
FIG. 2 shows a fuel supply device which includes a metering device, an electrical actuating device, and a fuel pump.

It is understood that fuel supply control valve 22 may also be designed as a unit with piston pump 24 (see FIG. 2). In particular, fuel supply control valve 22 may be a forcibly openable inlet valve 48 (see FIG. 2) of piston pump 24.

During operation of fuel system 10, pre-feed pump 16 conveys fuel from fuel tank 12 into low-pressure line 18. Fuel supply control valve 22 controls the quantity of fuel that is supplied to a feed chamber 25 of piston pump 24. Fuel supply control valve 22 may be closed and opened as a function of a particular need for fuel. The fuel is gasoline or diesel fuel, for example.

FIG. 2 shows piston pump 24 from FIG. 1 together with fuel supply control valve 22 and electrical actuating device 20 in a slightly more detailed but likewise schematic illustration. Piston pump 24 includes a housing 40 in which electrical actuating device 20, which includes a solenoid 42 and an armature 44, is situated in the left section of the drawing. A resting seat 43 for armature 44 is situated in the end section of housing 40, at the left in the drawing.

In addition, piston pump 24 includes an inlet 46 which is connected to low-pressure line 18 via inlet valve 48, and an outlet 50 which is connected to high-pressure line 26 via an outlet valve 52. Inlet valve 48 includes a valve spring 53 and a valve element 54. Inlet valve 48 is hydraulically connected to feed chamber 25 via an opening (no reference numeral).

Valve element 54 may be forcibly held in a second position 47 (illustrated in dashed lines) with the aid of a valve needle 55, which is horizontally displaceable in the drawing and coupled to armature 44. A first position 45 corresponds to a closed metering device 22, and second position 47 corresponds to an open metering device 22.

If electrical actuating device 20 is not energized, inlet valve 48 may be closed by the force of valve spring 53 ("closed in the de-energized state"). When electrical actuating device 20 is energized, armature 44 may be moved to the right in the drawing against a lift stop 49 with the aid of magnetic force, and valve element 54 may thus forcibly switch from first position 45 into second position 47. As a result, inlet valve 48 opens. Due to the (active) switching of armature 44 or of valve element 54, operating noise may occur which corresponds to the particular intensity of the activation of electrical actuating device 20.

During operation of fuel system 10, piston pump 24 conveys fuel from inlet 46 to outlet 50, outlet valve 52 opening or closing, corresponding to a particular pressure difference between feed chamber 25 and outlet 50. At full delivery of piston pump 24, inlet valve 48 is acted on by a particular pressure difference between inlet 46 and feed chamber 25. For a desired partial delivery, starting at a predefined point in time, electrical actuating device 20 is energized during a delivery stroke, as the result of which inlet valve 48 is not able to close, and the fuel that is still present in feed chamber 25 is conveyed back into low-pressure line 18. The volumes of piston pump 24 situated within housing 40 are essentially filled with fuel.

Figure 3:
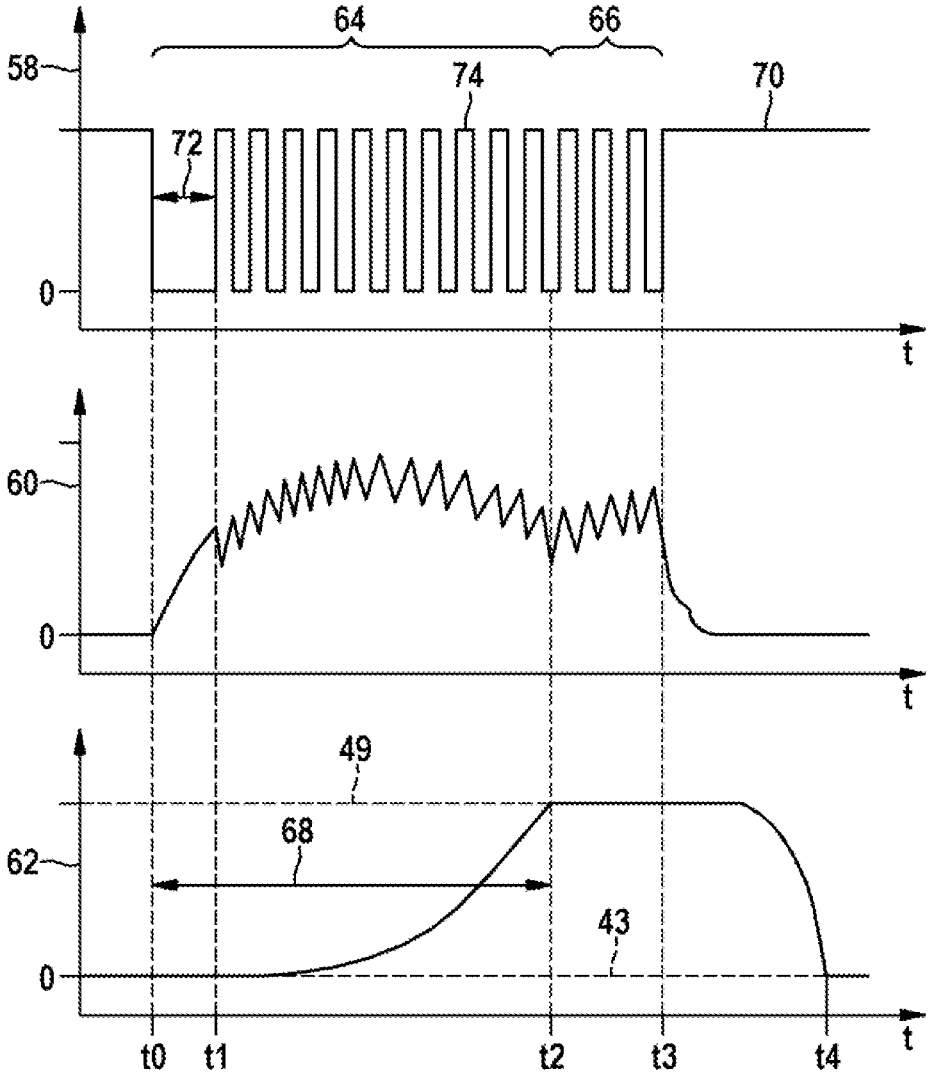
FIG. 3 shows a time diagram for an activation of the electrical actuating device.

FIG. 3 shows a time diagram for an activation of electrical actuating device 20. A time diagram at the top of the drawing shows an activation voltage 58 which is connected at a first terminal of solenoid 42. A middle time diagram in the drawing shows a current 60 associated with activation voltage 58. A bottom time diagram in the drawing shows a lift 62 of armature 44 associated with voltage 58 and current 60.

The diagrams have the same time scale (time t). All three diagrams have a respective zero value of activation voltage 58 and of current 60 and of lift 62, which is shown slightly above an associated abscissa. All three diagrams have a first time range 64, which corresponds to a pick-up phase of armature 44, and a subsequent second time range 66, which corresponds to an energization during a holding phase of armature 44 at lift stop 49. In the bottom diagram, the zero value corresponds to a stop of armature 44 against resting seat 43, and a horizontal dashed line corresponds to lift stop 49.

The activation of solenoid 42 and of electrical actuating device 20 illustrated in FIG. 3 has a "reduced current profile" in which a pick-up speed of armature 44 in the direction of second position 47 of valve element 54 is comparatively low, and an associated pick-up duration 68 is correspondingly great. Thus, the illustrated current profile may be used for switching valve element 54, in particular at comparatively low speeds of the internal combustion engine.

Activation voltage 58 is depicted in the top diagram. A second terminal (not illustrated) of solenoid 42 is continuously switched against a battery voltage 70. The first terminal (not illustrated) of solenoid 42 may be switched between battery voltage 70 and a ground potential ("0") with the aid of an electronic switch, as the result of which solenoid 42 and electrical actuating device 20 are activated, and current 60 may flow.

A first phase 72 of an activation begins at a point in time t0. Activation voltage 58 is continuously switched to zero during first phase 72, as the result of which current 60 in solenoid 42 rises in an approximately ramp-shaped manner. At a subsequent point in time t1, at which armature 44 has not yet struck against lift stop 49, first phase 72 ends and a second phase 74 begins. During second phase 74, activation voltage 58 is clocked in the manner of a pulse width modulation, and current 60 assumes an approximately sawtooth-shaped time curve. Armature 44 strikes against lift stop 49 at a subsequent point in time t2. A pick-up duration (t2−t0) of armature 44 is longer than a duration (t1−t0) of first phase 72.

In addition, a pulse duty factor of the pulse width modulation which takes place in second phase 74 may be changed. It is thus possible to change the time curve of current 60 virtually arbitrarily, and thus, to optimize the switching characteristic of fuel supply control valve 22. At a point in time t3 following point in time t2, the activation, and thus the energization, of solenoid 42 is terminated. Armature 44 once again reaches resting seat 43 at a subsequent point in time t4.

The activation of electrical actuating device 20 may take place in various ways. For example, during first phase 72, electrical actuating device 20 may be activated with a monotonically increasing curve of current 60, or with a first regulatable current 60. Likewise, during second phase 74, electrical actuating device 20 may be activated in the manner of a pulse width modulation, or may be activated with a second regulatable current. In general, an average current 60 in second phase 74 is less than in first phase 72. In addition, a third phase (not illustrated) following second phase 74 may be provided in which electrical actuating device 20 is activated or energized with the aid of a pulse width modulation or a third regulatable current 60. An average current 60 is generally higher in the third phase than in second phase 74.

For ascertaining a limiting case, described in greater detail below, the lengths of the three phases and/or the currents flowing in the particular phases may be individually changed.

Figure 4:
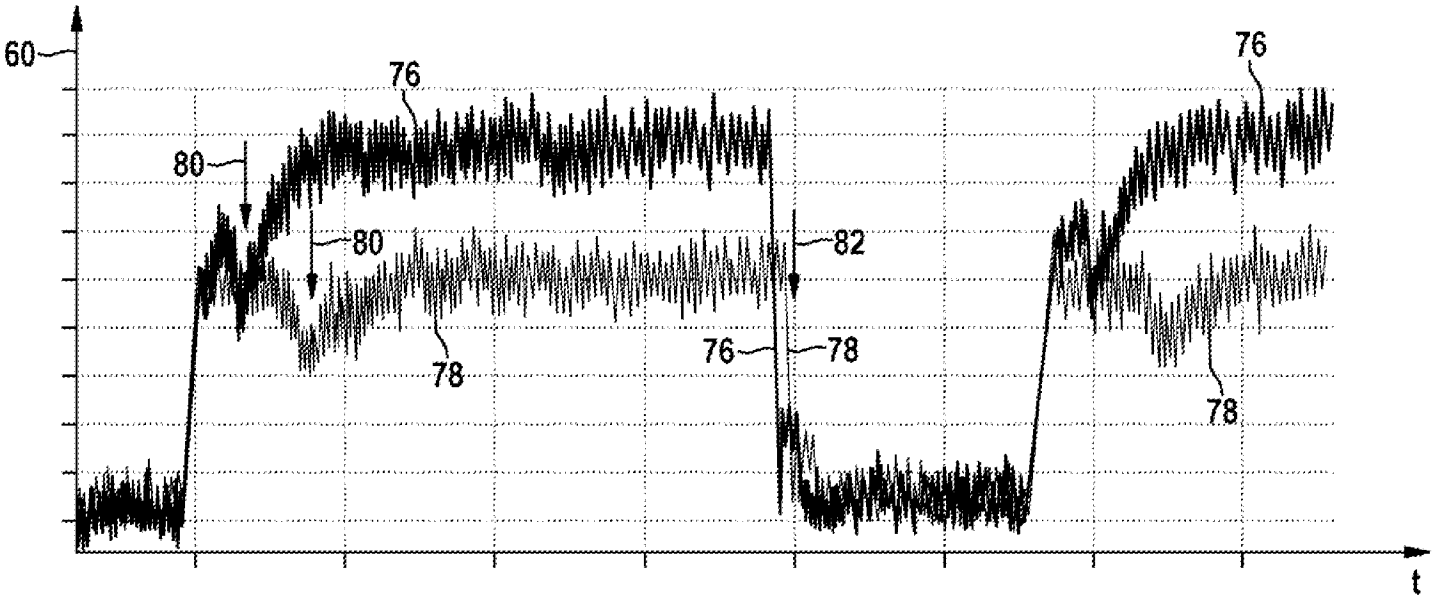
FIG. 4 shows a time diagram with currents for activating the electrical actuating device.

FIG. 4 shows two current curves 76 and 78 (current profiles, time curve of current 60) with currents 60 for activating electrical actuating device 20, similar to the middle time diagram in FIG. 3. Current curve 76 characterizes a first activation of electrical actuating device 20, in which valve element 54 is reliably switched from first position 45 into second position 47, regardless of possible specimen variations. For example, current curve 76 corresponds to a time curve of current 60, which may be set without using the method described in greater detail below in FIG. 6.

Current curve 78 characterizes a second activation of electrical actuating device 20, in which valve element 54 is activated with a reduced ("second") activation energy. In the present case, "activation energy" is generally understood to mean a respective time curve of current 60. A first arrow 80 characterizes a point in time at which fuel supply control valve 22 opens, and a second arrow 82 characterizes a point in time at which fuel supply control valve 22 closes.

The second activation energy is a "first" activation energy which is increased by an offset value. The first activation energy corresponds to the above-mentioned limiting case in which valve element 54 only just or just no longer switches from first position 45 into second position 47. The offset value is dimensioned in such a way that the second activation energy is much lower than an activation energy which corresponds to current curve 76, although valve element 54 is able to switch into second position 47, and the reliability of the switching is therefore not reduced. It is apparent that the second activation energy of current curve 78 is only approximately two-thirds of the activation energy of current curve 76.

Figure 5:
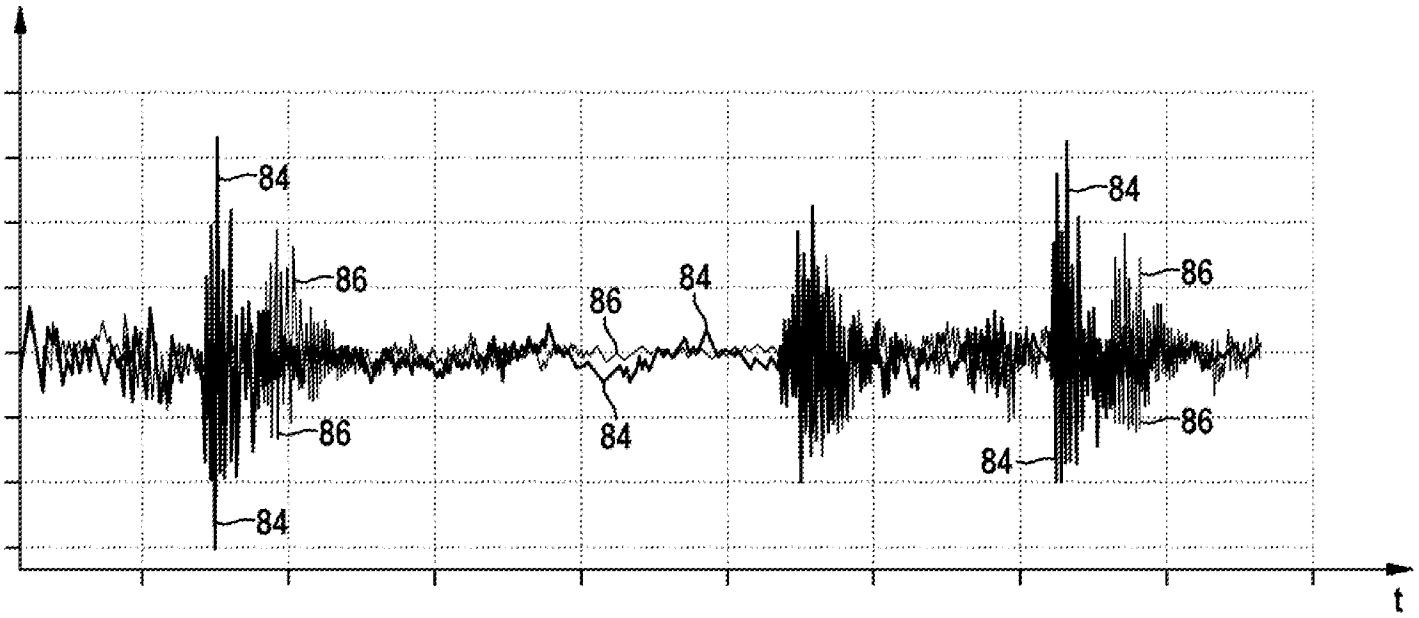
FIG. 5 shows a time diagram with time curves of operating noise of the electrical actuating device.

FIG. 5 shows a time diagram with time curves of a first operating noise 84 and a second operating noise 86 of electrical actuating device 20. First operating noise 84 corresponds to current curve 76, and second operating noise 86 corresponds to current curve 78 according to FIG. 4. It is apparent that second operating noise 86 is much lower than first operating noise 84.

Figure 6:
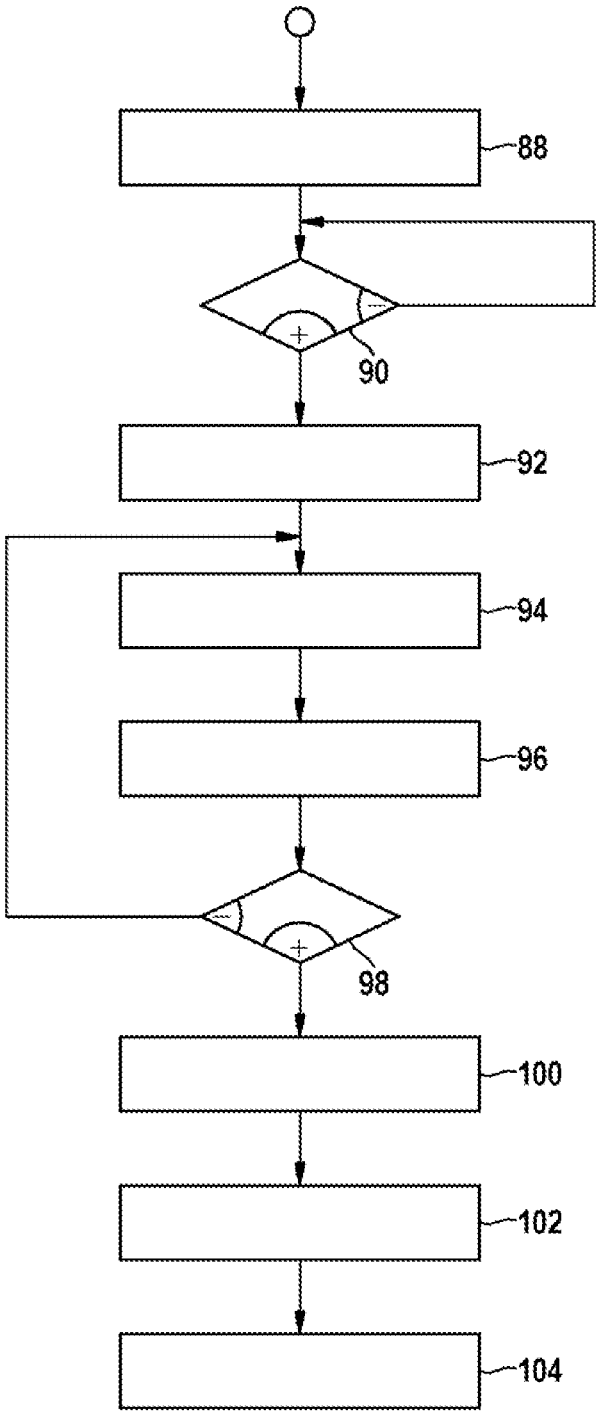
FIG. 6 shows a flow chart for carrying out a method for operating the fuel system.

FIG. 6 shows a flow chart for a method for operating fuel system 10. The present flow chart may preferably be processed with the aid of computer program 39. The illustrated procedure begins in a start block 88.

A check is made in a query block 90 as to whether a speed of the internal combustion engine is lower than a threshold value. If this is not the case, a branch is made back to the start of query block 90. If this is the case, a branch is made to a subsequent block 92. In block 92, electrical actuating device 20 is activated in a first cycle in such a way that valve element 54 is reliably forced into second position 47, for example using current curve 76.

With the aid of query block 90, a switch may be made between a first and a second type of operation of fuel supply control valve 22. The first type of operation characterizes comparatively high speeds, using a "maximum current profile" for activating electrical actuating device 20. The second type of operation characterizes comparatively low speeds, using a reduced current control (RECUR) of electrical actuating device 20. For example, the second type of operation characterizes so-called "close to idling" speeds.

Electrical actuating device 20 is activated in a subsequent block 94 in at least one second cycle with an activation energy which gradually drops by a difference value.

A fuel pressure ("pressure") in pressure accumulator 28 which is ascertained with the aid of pressure sensor 30 is evaluated in a subsequent block 96. For example, a check is made as to whether the pressure and/or a pressure change and/or a rate of pressure change in pressure accumulator 28 has/have exceeded a threshold value. It is taken into account that when an instantaneous activation energy of electrical actuating device 20 is not, or no longer, sufficient to force valve element 54 from first position 45 into second position 47 during a delivery stroke, piston pump 24 carries out a so-called full delivery. This case of full delivery may be ascertained via a comparatively rapid rise in the pressure in pressure accumulator 28.

A check is made in a subsequent query block 98 as to whether a pressure change which exceeds the threshold value has been ascertained in preceding block 96. If this is not the case, the method is continued at the start of block 94, the activation energy being further decreased in block 94. However, if the threshold value has been exceeded, it is deduced that fuel supply control valve 22 is not, or no longer, open. This corresponds to a limiting case in which valve element 54 is only just or just no longer forced into second position 47. Alternatively or additionally, instead of the fuel pressure or in addition to the fuel pressure, activation voltage 58 and/or current 60 may be evaluated in blocks 96 and 98 in order to ascertain the limiting case.

A branch is then made to a subsequent block 100 in which the first activation energy corresponding to the limiting case is ascertained. The above-described offset value is ascertained or predefined as a function of the fuel pressure in pressure accumulator 28 and a fuel temperature and an electrical resistance of electrical lines 35, and is added to the first activation energy. The sum results in the second activation energy. The activation of electrical actuating device 20 is thus adapted to a specimen-dependent and/or speed-dependent switching characteristic of fuel supply control valve 22. The first and the second activation energy, and optionally the speed and a predefinable time curve of the activation, are stored in data store 37 for subsequent activations of electrical actuating device 20. This takes place using a characteristic map, for example.

Electrical actuating device 20 is subsequently activated with the second activation energy in a subsequent block 102. However, it is also possible to ascertain the first and the second activation energy as well as the offset value as a function of the speed of the internal combustion engine. Fuel supply control valve 22 may thus also be activated as a function of the speed. The procedure illustrated in FIG. 6 terminates in an end block 104.

It is understood that the ascertainment of the described limiting case may correspondingly also take place in the reverse manner. Starting from an activation energy in which valve element 54 does not reliably switch into second position 47, this activation energy is increased gradually until the limiting case is reached. In addition, the activation energy may also be gradually increased and decreased in alternation, as the result of which the limiting case may be ascertained more accurately if necessary.

What is claimed is:

1. A method for operating a fuel system for an internal combustion engine, the fuel system including a metering device for measuring a delivery quantity of the fuel being at least one of selectively openable and closable with the aid of an electrical actuating device, and a valve element of the metering device which is switched into a first position when the actuating device is not activated, and into a second position when the actuating device is activated, the method comprising:

(a) activating the electrical actuating device in at least one first cycle such that the valve element switches into the second position;

(b) activating the electrical actuating device in at least one second cycle in sequential multiple activations, with activation energy which decreases gradually, until a limiting case is reached in which the valve element one of only just switches into the second position or just no longer switches into the second position;

(c) ascertaining a first activation energy which corresponds to the limiting case; and (d) subsequently activating the actuating device, taking the first activation energy into account.

2. The method as recited in claim 1, wherein after step (c) the first activation energy is increased by an offset value, resulting in a second activation energy, the offset value being selected in such a way that the valve element switches into the second position, and the subsequent activation in step (d) takes place with the second activation energy.

3. The method as recited in claim 2, wherein the first position corresponds to a closed metering device, and the second position corresponds to an open metering device.

4. The method as recited in claim 2, wherein at least one of the second activation energy and a time curve of the activation corresponding to the second activation energy is stored in a data storage medium.

5. The method as recited in claim 4, wherein a time curve of the activation includes (i) a first phase having a monotonically increasing current curve, and (ii) a subsequent second phase in which the electrical actuating device is activated with the aid of a pulse width modulation, and wherein at least one of a duration of the first phase and a pulse duty factor of the pulse width modulation is changed in order to ascertain the limiting case.

6. The method as recited in claim 4, wherein a time curve of the activation includes (i) a first phase having a monotonically increasing current curve, and (ii) a subsequent second phase in which the electrical actuating device is energized with the aid of a regulatable current, and wherein at least one of a duration of the first phase and an intensity of the regulatable current is changed in order to ascertain the limiting case.

7. The method as recited in claim 4, wherein a time curve of the activation includes (i) a first phase in which the electrical actuating device is energized with the aid of a first regulatable current, and (ii) a subsequent second phase in which the electrical actuating device is energized with the aid of a second regulatable current, the second current being lower than the first current, and wherein at least one of a duration of the first phase and an intensity of the second regulatable current is changed in order to ascertain the limiting case.

8. The method as recited in claim 7, wherein the time curve of the activation includes a third phase following the second phase, and wherein in the third phase the electrical actuating device is one of activated or energized with the aid of one of a pulse width modulation or a third regulatable current.

9. The method as recited in claim 2, wherein the offset value is predefined as a function of at least one of a fuel pressure in a pressure accumulator, a fuel temperature, and an electrical resistance of an electrical line attached to the electrical actuating device.

10. The method as recited in claim 1, wherein the limiting case is determined by (i) ascertaining at least one of a pressure, a pressure change, and a rate of pressure change in a pressure accumulator of the fuel system, and (ii) comparing the at least one of the pressure, the pressure change, and the rate of pressure change in the pressure accumulator of the fuel system to a threshold value.

11. The method as recited in claim 1, wherein the limiting case is determined by ascertaining and evaluating at least one of a voltage and a current of the electrical actuating device.

12. A method for operating a fuel system for an internal combustion engine, the fuel system including a metering device for measuring a delivery quantity of the fuel being at least one of selectively openable and closable with the aid of an electrical actuating device, and a valve element of the metering device which is switched into a first position when the actuating device is not activated, and into a second position when the actuating device is activated, the method comprising:

(a) activating the electrical actuating device in at least one first cycle such that the valve element does not switch into the second position;

(b) activating the electrical actuating device in at least one second cycle in sequential multiple activations, with activation energy which increases gradually, until a limiting case is reached in which the valve element one of only just switches into the second position or just no longer switches into the second position;

(c) ascertaining a first activation energy which corresponds to the limiting case; and (d) subsequently activating the actuating device, taking the first activation energy into account.

13. A non-transitory, computer-readable data storage medium storing a computer program having program codes which, when executed on a computer, performs a method for operating a fuel system for an internal combustion engine, the fuel system including a metering device for measuring a delivery quantity of the fuel being at least one of selectively openable and closable with the aid of an electrical actuating device, and a valve element of the metering device which is switched into a first position when the actuating device is not activated, and into a second position when the actuating device is activated, the method comprising:

(a) activating the electrical actuating device in at least one first cycle such that the valve element switches into the second position;

(b) activating the electrical actuating device in at least one second cycle in sequential multiple activations, with activation energy which decreases gradually, until a limiting case is reached in which the valve element one of only just switches into the second position or just no longer switches into the second position;

(c) ascertaining a first activation energy which corresponds to the limiting case; and (d) subsequently activating the actuating device, taking the first activation energy into account.

* * * * *